US005203860A

United States Patent [19]

Bollant

[11] Patent Number: 5,203,860

[45] Date of Patent: Apr. 20, 1993

[54] WATER MATTRESS AND ANCHOR APPARATUS

[76] Inventor: Patrick J. Bollant, 57 Knutson Dr., Madison, Wis. 53704

[21] Appl. No.: 864,560

[22] Filed: Apr. 7, 1992

[51] Int. Cl.[5] ..... B63B 21/00

[52] U.S. Cl. ..... 441/40; 114/293

[58] Field of Search ..... 441/35, 40, 42, 44, 441/45, 3, 75, 129; 114/343, 345, 264, 266, 267, 230, 293, 294, 301, 304–307; D21/236, 237; 272/1 B, 32

[56] References Cited

U.S. PATENT DOCUMENTS 4,254,730 3/1981 Crenshaw ..... 114/294
4,543,904 10/1985 Puoti ..... 114/294
4,729,331 3/1988 Eggleston ..... 114/294
4,775,346 10/1988 Gunter ..... 441/129
4,785,758 11/1988 Eichelberger ..... 114/299
4,913,672 4/1990 Martin ..... 441/40

*Primary Examiner*—Joseph F. Peters, Jr.
*Assistant Examiner*—Clifford T. Bartz
*Attorney, Agent, or Firm*—Leon Gilden

[57] ABSTRACT

A pneumatic mattress is arranged to include a recess within a pneumatic chamber of a plurality of pneumatic chambers to permit positioning of an anchor to provide for storage and transport of the anchor during periods of non-use. The anchor is arranged with annular upper and lower anchor ribs to enhance engagement for securement and tethering of the mattress.

8 Claims, 4 Drawing Sheets

WATER MATTRESS AND ANCHOR APPARATUS

BACKGROUND OF THE INVENTION

1. Field of the Invention

The field of invention relates to mattress apparatus, and more particularly pertains to a new and improved water mattress and anchor apparatus wherein the same is arranged to permit selective positioning of a pneumatic mattress relative to a body of water.

2. Description of the Prior Art

Pneumatic mattresses of various types are utilized throughout the prior art for comfort and convenience permitting an individual to be supported about an upper surface of a body of water. Anchor structure available in the prior art to support a mattress or raft structure is exemplified in the U.S. Pat. No. 4,729,331 to Eggleston wherein a swim raft includes a mattress mounted relative to the raft by adhesive bonding of an anchor line support to the mattress structure.

U.S. Pat. No. 4,928,618 to Kubi sets forth a connector and anchor structure relative to a boat.

U.S. Pat. No. 4,721,054 sets forth another example of an anchor device.

As such, it may be appreciated that there continues to be a need for a new and improved water mattress and anchor apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pneumatic mattress structure now present in the prior art, the present invention provides a water mattress and anchor apparatus wherein the same is arranged to provide for the selective positioning of an anchor within a pneumatic mattress structure during periods of non-use. As such, the general purpose of the present invention, which will be described subsequently in greater detail, is to provide a new and improved water mattress and anchor apparatus which has all the advantages of the prior art water mattress apparatus and none of the disadvantages.

To attain this, the present invention provides a pneumatic mattress arranged to include a recess within a pneumatic chamber of a plurality of pneumatic chambers to permit positioning of an anchor to provide for storage and transport of the anchor during periods of non-use. The anchor is arranged with annular upper and lower anchor ribs to enhance engagement for securement and tethering of the mattress.

My invention resides not in any one of these features per se, but rather in the particular combination of all of them herein disclosed and claimed and it is distinguished from the prior art in this particular combination of all of its structures for the functions specified.

There has thus been outlined, rather broadly the more important features of the invention in order that the detailed description thereof that follows may be better understood, and in order that the present contribution to the art may be better appreciated.There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water mattress and anchor apparatus which has all the advantages of the prior art pneumatic mattress structure and none of the disadvantages.

It is another object of the present invention to provide a new and improved water mattress and anchor apparatus which may be easily and efficiently manufactured and marketed.

It is a further object of the present invention to provide a new and improved water mattress and anchor apparatus which is of a durable and reliable construction.

An even further object of the present invention is to provide a new and improved water mattress and anchor apparatus which is susceptible of a low cost of manufacture with regard to both materials and labor, and which accordingly is then susceptible of low prices of sale to the consuming public, thereby making such water mattress and anchor apparatus economically available to the buying public.

Still yet another object of the present invention is to provide a new and improved water mattress and anchor apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
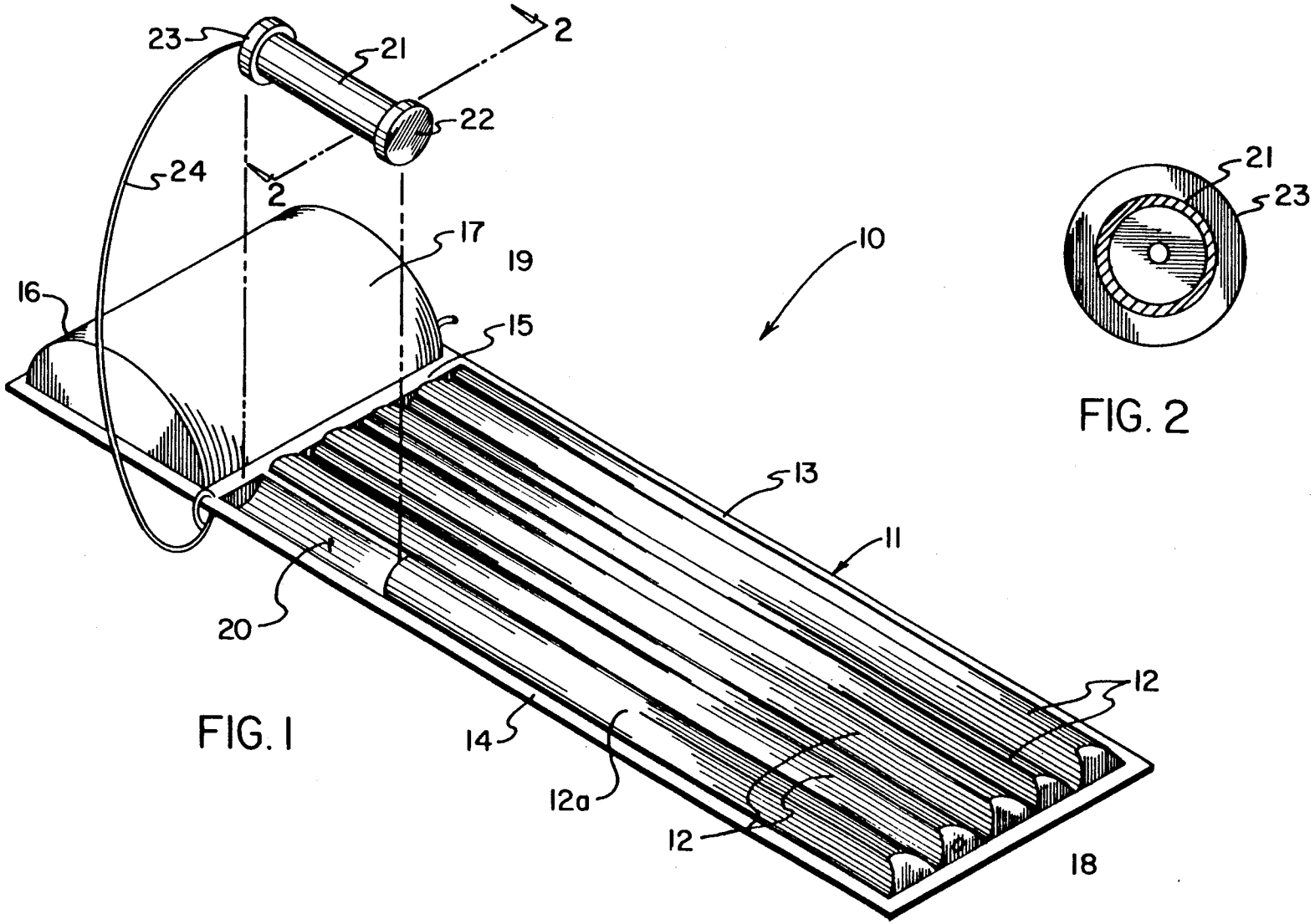
FIG. 1 is an isometric illustration of the instant invention.
FIG. 2 is an orthographic view, taken along the lines 2—2 of FIG. 1 in the direction indicated by the arrows.

With reference now to the drawings, and in particular to FIGS. 1 to 7 thereof, a new and improved water mattress and anchor apparatus embodying the principles and concepts of the present invention and generally designated by the reference numerals 10 and **10*a*** will be described.

More specifically, the water mattress and anchor apparatus 10 of the instant invention essentially comprises a pneumatic air mattress 11 having parallel first pneumatic chambers 12 of a first length positioned adjacent a second pneumatic chamber **12*a*, with the second pneumatic chamber 12*a* positioned in a parallel relationship relative to a second side 14 of the air mattress spaced from a first side 13. A first inner end 15 is spaced from a first outer end 16 having a pneumatic cushion 17 therebetween. A first inflation valve 18 and a second inflation valve 19 effects selective inflation of the chambers 12, 12*a* and the cushion 17 respectively. A semi-cylindrical cavity 20 extends from an upper distal end of the second pneumatic chamber 12*a* to the first inner end 15, wherein as illustrated, the first pneumatic chamber 12 is of a first length and the second pneumatic chamber 12*a* is of a second length less than the first length. The semi-cylindrical cavity 20 is arranged for removably receiving an anchor cylinder 21 therewithin. The anchor cylinder 21 has a lower annular anchor rib 22 spaced from an upper annular anchor rib 23, with the anchor ribs arranged in a concentric relationship relative to the axis of the anchor cylinder 21. A tether line 24 extending from the upper annular rib 23 is tethered to the air mattress 11**.

In this manner, the anchor is arranged for reception within the semi-cylindrical cavity 20 for ease of storage and transport of the anchor during periods of non-use.

Figure 3:
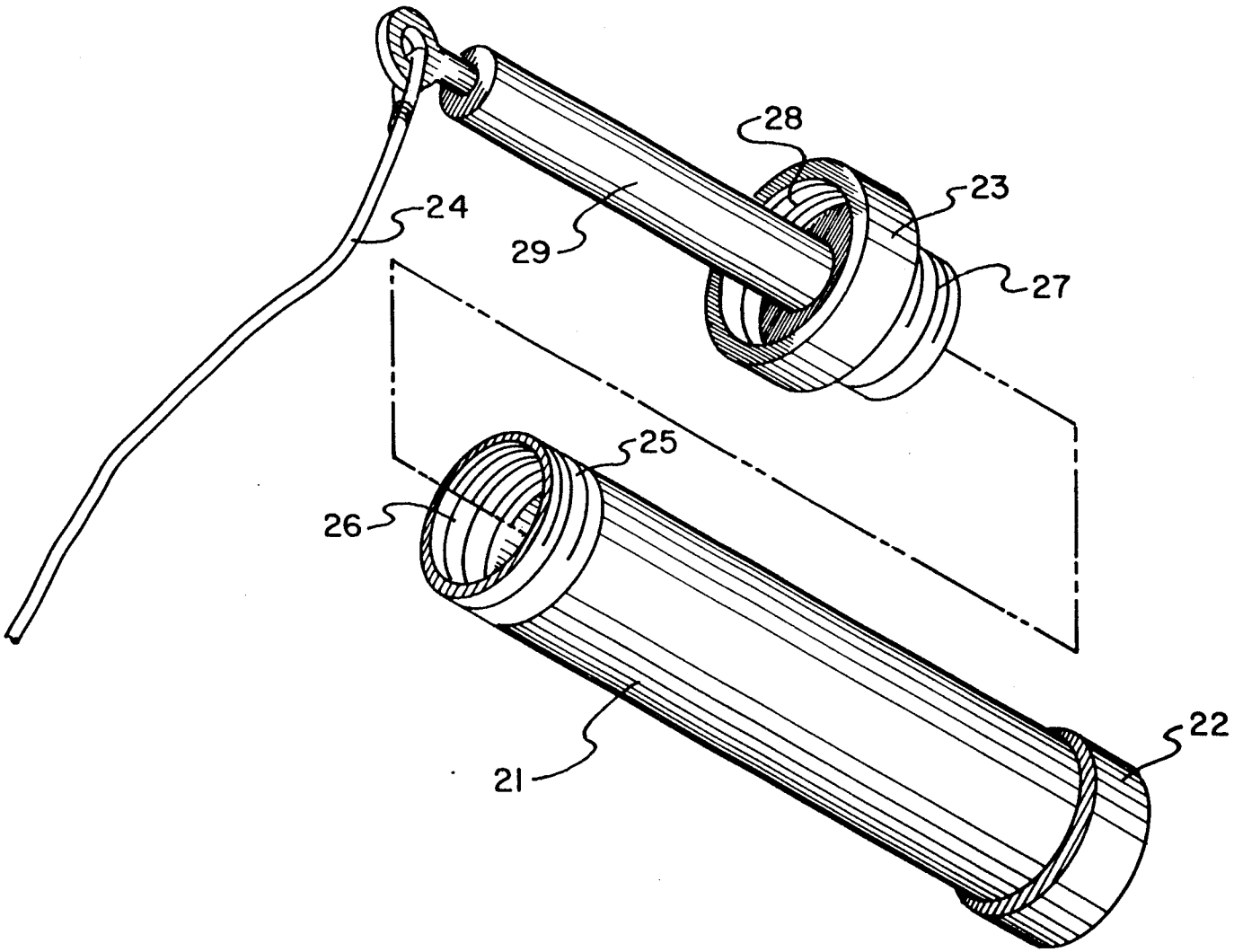
FIG. 3 is an isometric illustration of the anchor member in an exploded view illustrating the various components thereof.

The anchor, as illustrated in FIG. 3, includes the anchor cylinder 21 of a tubular construction having an externally threaded upper end 25, as well as an internally threaded upper end 26. The upper annular rib 23 is formed as a part of a cap, wherein the cap includes an externally threaded skirt 27 projecting below the upper anchor rib 23, with the externally threaded skirt 27 arranged for threaded inter-engagement with the internally threaded end portion 26. The skirt has internally threaded upper surface 28 spaced above and concentric with the externally threaded skirt 27, with the upper surface 28 positioned interiorly of the upper anchor rib 23 for threaded inter-engagement with the anchor cylinder's forward externally threaded end 25. In this manner, the anchor including a central mandrel 26 fixedly and coaxially mounted to the cap member having a tether line secured thereto, permits the tether line to be wound about the mandrel 29 and positioned within the tubular anchor cylinder 21 for storage of the tether line when mounted to the semi-cylindrical cavity 20.

Figures 4, 5:
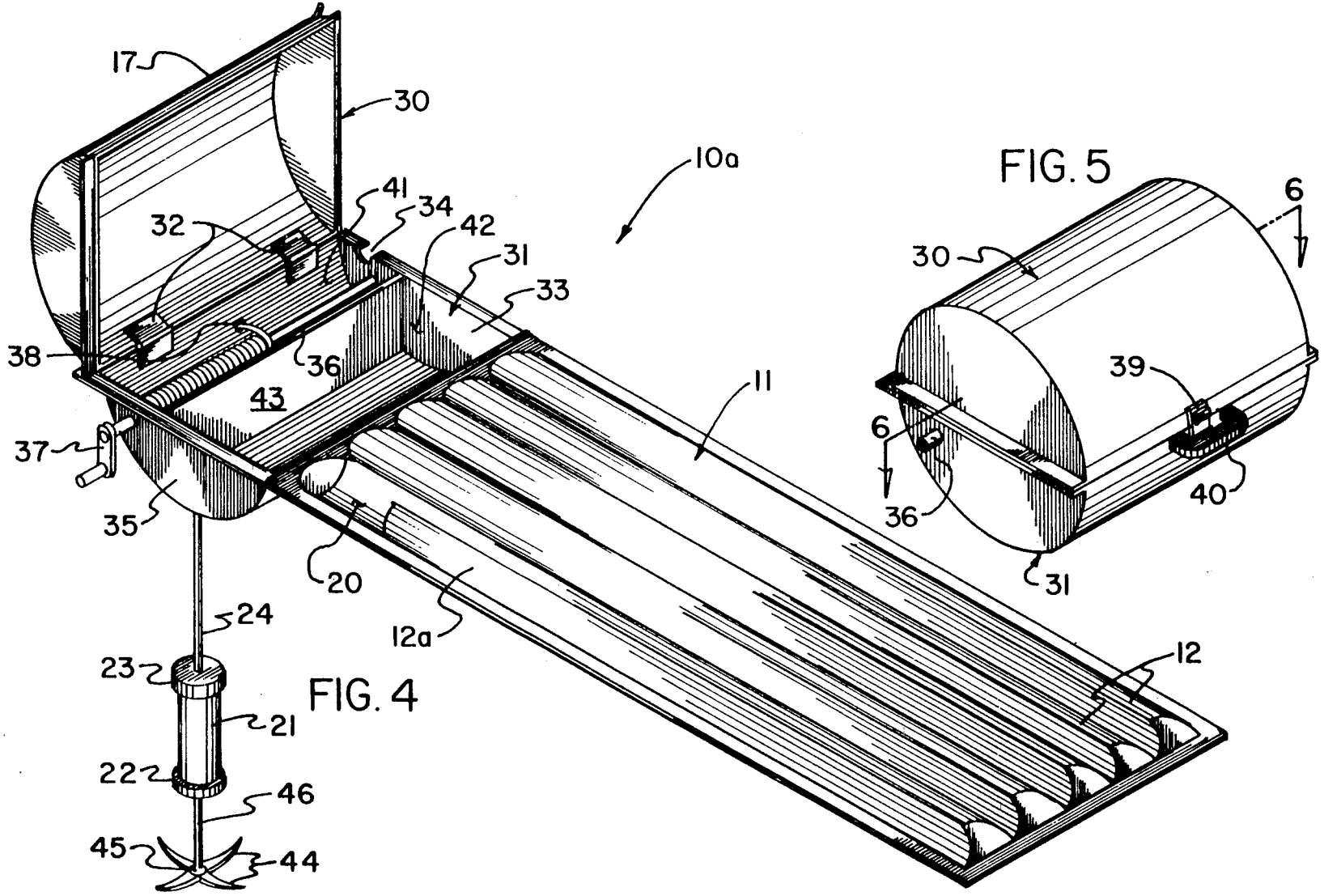
FIG. 4 is an isometric illustration of a modification of the invention.
FIG. 5 is an isometric illustration of the modification of the invention in an interfolded configuration.
Figure 7:
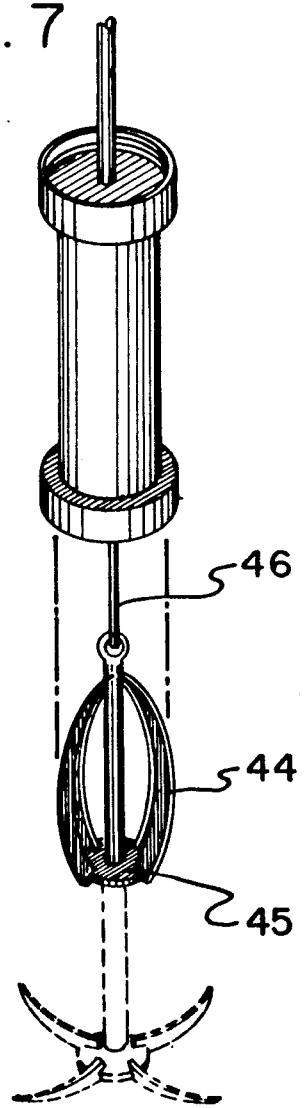
FIG. 7 is an isometric enlarged illustration of the anchor structure of the invention as set forth in FIG. 4.
Figure 6:
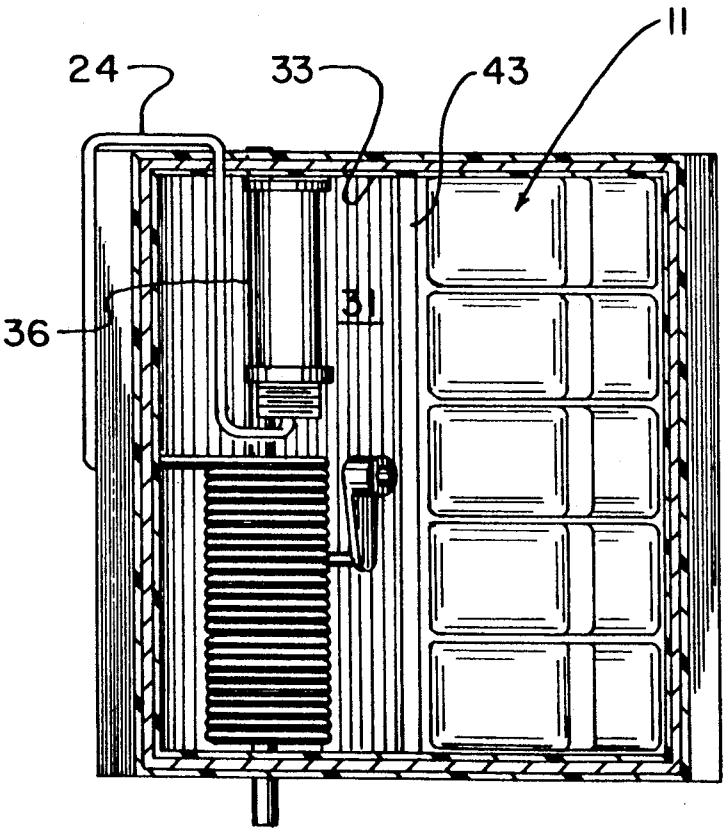
FIG. 6 is an orthographic view, taken along the lines 6—6 of FIG. 5 in the direction indicated by the arrows.

The apparatus **10*a*, as illustrated in the FIGS. 4–7, includes an upper semi-cylindrical lid 30 arranged for securement to a lower semi-cylindrical container 31 having hinges 32 pivotally mounting the upper lid 30 to the lower container 31, with a latch 39 arranged for securement of the lid and container together, with the latch and hinges arranged in diametrically opposed positions relative to the container lid structure. The lower container includes a lower container first end wall 33 spaced from a lower container second end wall 35, with a first end wall recess 34 directed through an upper edge of the first end wall 33 to permit the tether line 24 to be directed therethrough, in a manner as illustrated in FIG. 6, during storage of the components within the lid of the container structure. It should be noted that the pneumatic cushion 17 in the apparatus 10*a* is mounted coextensively about an outer surface of the upper semi-cylindrical lid 30 for use as a cushion structure in conjunction with the mattress 11. An axle 36 is rotatably mounted orthogonally through the first and second end walls 33 and 35 having an axle handle 37 removably mounted relative to the outer distal end of the axle 36 positioned exteriorly of the second end wall 35. A tether line opening 38 is directed through the lower container 31, with the tether line arranged for mounting for a winding about the axle 36 for lifting of the anchor. A handle 40 is mounted adjacent the latch 39 to the lower container 31 for transport of the organization, wherein the container includes a first container cavity 41 spaced from a second container cavity 42 divided by a divider wall 43, wherein the axle is mounted within the first container cavity 41 and the air mattress when deflated is received within the second container cavity 42 for ease of transport of the organization in a unitary manner, as illustrated in FIG. 5. The anchor in this manner may be positioned within the semi-cylindrical cavity 20 when the air mattress is inflated and projecting from the lower container 31, in a manner as illustrated in FIG. 4, or when transport and storage of the organization as a unit is desired, the anchor is positioned within the first container cavity 41 adjacent the axle 36 with the anchor line 24 directed through the first end wall recess 34, in a manner as illustrated in FIG. 6. The anchor is arranged to optionally include anchor legs 44 pivotally mounted and projecting radially relative to an anchor leg plate 45 that is mounted to a lower distal end of a lower tether line 46 that is secured coaxially to the anchor cylinder 21 to the lower anchor rib 22. In this manner, the lower anchor legs 44 and the plate structure, as well as the lower tether line 46 is arranged for removal if such structure is deemed unnecessary in use of the anchor organization and as such this structure may be stored within the first container cavity 41**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water mattress and anchor apparatus, comprising, a pneumatic air mattress, the pneumatic air mattress having a first side spaced from a second side, and a first inner end spaced from a first outer end having a pneumatic cushion mounted between the first inner end and the first outer end, and a plurality of first pneumatic chambers extending from the first side, with the first pneumatic chambers arranged in a parallel relationship relative to one another, and the second side having a second pneumatic chamber extending along the second side from a lower distal end of the second side in a spaced relationship relative to the first inner end, wherein the first pneumatic chambers extend from a lower distal end of the air mattress beyond the second pneumatic chamber to the first inner end, and a cavity extending from the second pneumatic chamber to the first inner end, and an anchor removably mounted within the cavity.

2. An apparatus as set forth in claim 1 wherein the anchor includes a central tubular housing defined about a housing axis and a lower anchor rib and an upper anchor rib concentric with the housing axis, with the lower anchor rib mounted to a lower distal end of the anchor cylinder and the upper anchor rib removably mounted relative to an upper distal end of the anchor cylinder.

3. An apparatus as set forth in claim 2 wherein the upper anchor rib includes an externally threaded skirt extending below the anchor rib and an internally threaded anchor rib interior surface, and the anchor cylinder having an externally threaded upper distal end and the upper distal end having an internally threaded portion, with the internally threaded portion arranged for securement to the externally threaded skirt, and the externally threaded end arranged for securement to the internally threaded surface.

4. An apparatus as set forth in claim 3 including a central mandrel mounted coaxially of the upper anchor rib, and a tether line secured to the mandrel, with the tether line extending from the mandrel to the air mattress.

5. An apparatus as set forth in claim 4 wherein the first outer end and the first inner end include a lower semi-cylindrical container hingedly mounted to an upper semi-cylindrical lid, with the upper semi-cylindrical lid including the pneumatic cushion mounted to an outer surface of the upper semi-cylindrical lid, and the upper semi-cylindrical lid including at least one hinge securing the upper semi-cylindrical lid to the lower container, and a latch diametrically opposed and mounted to the upper semi-cylindrical lid and to the lower container arranged for securement of the upper lid to the lower container.

6. An apparatus as set forth in claim 5 including a handle mounted to the lower container adjacent the latch.

7. An apparatus as set forth in claim 6 wherein the lower container includes a first end wall spaced from and parallel a second end wall, the first end wall including a first end wall recess formed to an upper edge of the first end wall and the lower container having a first container cavity and a second container cavity, with a divider wall extending coextensively at an interface between the first container cavity and the second container cavity, and an axle orthogonally directed through the first end wall and the second end wall through the first container cavity, with the axle having an axle handle removably mounted relative to an outer end of the axle exteriorly of the second end wall, and the axle including a tether line secured thereto, and the lower container including a tether line opening directed through the lower container between the first end wall and the second end wall, and the second container cavity arranged for reception of the pneumatic air mattress therewithin, with the pneumatic air mattress fixedly secured to the lower container at the first inner end.

8. An apparatus as set forth in claim 7 wherein the lower anchor rib includes a lower tether line extending therebelow secured to the lower anchor rib, with the lower tether line including an anchor plate, the anchor plate including a plurality of anchor legs pivotally mounted to the lower anchor plate radially oriented relative to the anchor plate.

* * * * *